United States Patent [19]

Rathmann

[11] Patent Number: 4,466,263

[45] Date of Patent: Aug. 21, 1984

[54] DEVICE FOR THE UNLOCKING AND LOCKING OF DOORS

[75] Inventor: Klaus Rathmann, Frankfurt am Main, Fed. Rep. of Germany

[73] Assignee: VDO Adolf Schindling AG, Frankfurt am Main, Fed. Rep. of Germany

[21] Appl. No.: 380,500

[22] Filed: May 21, 1982

[30] Foreign Application Priority Data

May 29, 1981 [DE] Fed. Rep. of Germany ..... 3121367

[51] Int. Cl.[3] ..... E05B 53/00

[52] U.S. Cl. ..... 70/264; 70/275; 70/277

[58] Field of Search ..... 70/275, 277, 264; 92/90; 307/132 R

[56] References Cited

U.S. PATENT DOCUMENTS

| | | | |
|---|---|---|---|
| 3,096,112 | 7/1963 | Johnstone | 292/3 |
| 3,593,816 | 7/1971 | Kazaoka | 70/264 X |
| 4,270,371 | 6/1981 | Kalk | 70/264 |
| 4,322,959 | 4/1981 | Mochida | 70/264 X |

FOREIGN PATENT DOCUMENTS

| | | | |
|---|---|---|---|
| 3008272 | 9/1981 | Fed. Rep. of Germany | 70/275 |
| 2457366 | 1/1981 | France | 70/264 |
| 2469309 | 5/1981 | France | 70/264 |

*Primary Examiner*—Thomas J. Holko
*Assistant Examiner*—Thomas J. Dubnicka
*Attorney, Agent, or Firm*—Martin A. Farber

[57] ABSTRACT

A device for the unlocking and locking of doors having pneumatic setting members in the individual door-locking mechanisms is provided centrally with a pneumatic pump (19) having a motor (18) of controlled direction of rotation. This motor can be controlled by means of a DC door switch (2). Immediately after a pressure build-up or vacuum build-up a holding-circuit switch (23) closes a holding circuit so that the DC motor (18) which drives the pneumatic pump (19) continues to operate even if it is immediately switched back directly after the making of contact by the door switch (2).

Upon an increase in vacuum or pressure, a contact finger (26) of the holding-circuit switch (23) displaces a contact bridge in such a way that it actuates a bistable change-over switch (10) via mechanical transmission members. This change-over switch (10) disconnects the DC motor (18) from the source of voltage and makes it possible for the DC motor (18) to start up in the opposite direction of rotation upon the next following actuation of the door switch.

10 Claims, 1 Drawing Figure

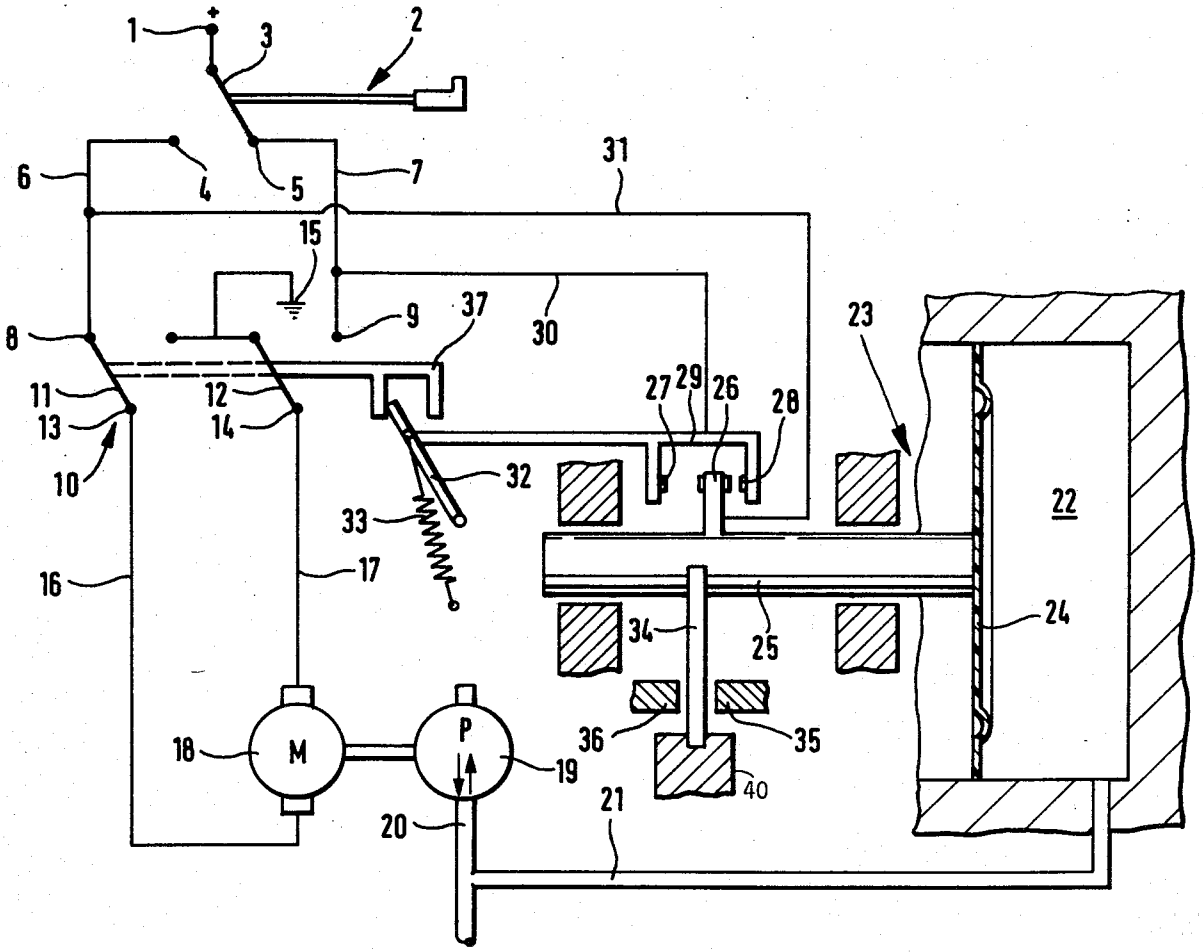
1
2
3
4
5
6
7
8
9
10
11
12
13
14
15
16
17
18
19
20
21
22
23
24
25
26
27
28
29
30
31
32
33
34
35
36
37
40
P
M

DEVICE FOR THE UNLOCKING AND LOCKING OF DOORS

The present invention refers to a device for the unlocking and locking of doors, particularly the doors of automotive vehicles, in which locking mechanisms with pneumatic setting members are provided on individual doors and a pneumatic pump having a motor of controlled direction of rotation is provided centrally, the device being actuated via a door key by at least one door switch having two fixed contacts, and a holding circuit controlled by a holding-circuit switch being provided for both positions, by which assurance is provided, even upon merely a brief making of contact by the door switch, that the setting members always move into one end position, the device having means by which the current is switched off from the device when the end position of the setting members is reached. One such device is disclosed in U.S. Pat. No. 3,096,112.

In devices of this type, which are generally referred to as central locking, it is necessary for setting members to always move into their end position and not to remain in an intermediate position. Therefore, in both switch positions of the door switch a holding circuit must first of all be closed as soon as the device is actuated by the making of contact by the door key. This holding circuit may be opened only when all the setting members have come into an end position. In this way the result is obtained that the setting members travel fully into the locking or unlocking position even upon only brief contact with the locking contact or unlocking contact in the door switch.

In the known device, these holding circuits are closed by a pneumatically actuated switch device which, immediately after the start of a pressure build-up or vacuum build-up within the system, closes one of its two switches. For this purpose, a switch projection slides over a switch rocker and, depending on the direction of movement, closes one or the other switch of the switching device. If the pressure in the system has risen, for instance, to 0.5 bar, then the projection releases the switch rocker, with the result that the holding circuit is again opened. Upon the return movement, the switch contacts must be swung away so that the switch contact cannot be again closed.

In the known device, the pneumatic switch device represents a relatively complicated and therefore expensive component which must be carefully adjusted so that the switches switch properly upon the starting of the pump and the reaching of the desired pressure. Aside from this, the electric circuit of the device of U.S. Pat. No. 3,096,112 is so designed that in order to drive the pneumatic pump, a motor having two seperate windings in order to produce different directions of rotation is necessary.

Another disadvantage of the known device is that a command from the door switch is only taken into account if the device is in its position of rest. If, for instance, the locking command is given during the unlocking by the door switch, this signal is disregarded so that the doors come into unlocked position and the car is thus not locked.

The object of the present invention is to develop a device of the afore-mentioned type which is of the simplest possible development and thus can be manufactured inexpensively, while being robust and operates reliably, and in which a command given by the door switch is carried out regardless of whether the device is in a state of rest or in a state of movement.

BRIEF DESCRIPTION OF THE DRAWING

The FIGURE is a schematic view of the present invention.

This object is achieved in accordance with the invention in the manner that:

(a) the holding circuit switch (23) has a contact finger (26) on a piston rod (25) which is axially displaceable by its diaphragm (24), said contact finger (26) extending between two contacts (27, 28) of a contact bridge (29) which is displaceable parallel to the piston rod (25);

(b) the change-over switch (10) has two bistable switch members (11, 12) arranged parallel to each other, each of which, depending on the switch position, makes electric connection to a fixed contact (4, 5) of the door switch (2) and to a ground connection (car body 15), respectively.

(c) the contact bridge (29) is mechanically connected with the switch members (11, 12) of the change-over switch (10);

(d) the two contacts (27, 28) of the contact bridge (29) are electrically connected to one fixed contact (5) of the door switch (2) while the contact finger (26) is connected to the other fixed contact (4);

(e) the fixed contacts (4, 5) of the door switch are connected electrically to the DC motor (18) via the change-over switch (10).

The device of the invention has numerous advantages. With respect to its operation it is to be emphasized that in its state of rest the device necessarily assumes the position which is associated with the door switch position. This is true, for instance, even if, with the vehicle locked, the door switch is first briefly brought against the unlocking contact and then switched back to locking. The cost of manufacture of the device of the invention is less than that of the device in accordance with U.S. Pat. No. 3,096,112, since an ordinary DC motor can be used and the holding circuit switch is of substantially simpler construction than the switch device with switch rocker of that patent. While the device in accordance with the invention requires a bistable toggle switch with two switch members in addition to the main circuit switch, such switches are, however, also in general use and therefore obtainable at low cost.

One advantageous embodiment of the invention is characterized by the fact that the piston rod (25) is held in a basic position by a flexure beam (34) whose spring line characteristic is bent off once in both directions of movement by stops (35, 36). By these features it is possible in a particularly simple manner to obtain the result that with a high degree of precision, the holding circuit switch closes the bistable change-over switch at a fixed first pressure point and actuates at a fixed second pressure point.

The second pressure point, at which the bistable change-over switch is actuated, can be accurately adjusted in a particularly simple fashion by making the stops (35, 36) displaceable in the longitudinal direction of the flexure beam (34).

The invention permits of numerous possible embodiments. One of these is shown diagrammatically in the accompanying drawing and will be described below. The drawing shows a preferred device of the invention in state of rest, in which, for instance, the door locks are unlocked. In the drawing there is shown a battery terminal 1 from which current can pass to a door switch 2. Depending on the position of the switch member 3 of this door switch 2, current is conducted to one of two fixed contacts 4, 5 of the door switch 2. From the fixed contacts 4, 5, electric wires 6, 7 lead to contacts 8, 9 of a change-over switch 10 which is dependent on the system pressure. The change-over switch 10 has two switch members 11, 12 parallel to each other which produce either a connection from contact 8 to a contact 13 or from the contact 9 to a contact 14, depending on the position of the switch. In the position shown in the drawing, the contact 14 is connected via the switch member 12 to the vehicle ground 15. If the switch 10 is switched, the contact 13 is then connected to the vehicle ground 15 and the contact 14 to the contact 9.

From the contacts 13, 14, wires 16, 17 lead to the contacts of a DC motor 18 which drives the pump 19, the pump producing pressure or vacuum in a pressure conduit 20 depending on the direction of rotation. The pressure conduit 20 leads to switch members (not shown) of the device. From the pressure conduit 20, however, there branches off a conduit 21 which leads into a pressure chamber 22 of a holding circuit switch 23. The holding circuit switch 23 has a piston rod 25 which is axially displaceable by a diaphragm 24 and has a radially directed contact finger 26 which extends between two contacts 27, 28 of a contact bridge 29. The contact bridge 29 and thus also the contacts 27, 28 are connected via a wire 30 to the wire 7 and thus to the fixed contact 5 while the contact finger 26 is connected via a wire 31 to the wire 6 and thus to the fixed contact 4 of the door switch 2.

The contact bridge 29 can be displaced parallel to the axis of the piston rod 25 and is mechanically connected with the change-over switch 10. In the case of the embodiment shown in the drawing, the contact bridge 29 is pivoted to a lever 32 which is urged by a tension spring 33 into each of its two end positions. When the lever 32 is swung beyond its neutral position by displacement of the contact bridge 29, it snaps into its other end position and thereby abruptly switches the change-over switch 10.

The piston rod 25 is kept in the basic position shown by means of a flexure beam 34. This flexure beam 34 is freely movable between two stops 35, 36. In this way, upon displacement of the piston rod 25, the flexure beam 34 is first flexed over its entire length. As soon as it comes against one of the stops 35, 36, its length which is flexed upon displacement of the piston rod 25 is shortened. There is thus produced a spring characteristic which has a single inflexion. The ends of the flexure beam 34 are secured to rod 25 and to fixed part 40.

The device described operates as follows. If switching is to be effected from the unlocked position shown in the drawing into the locked position, then the door switch 2 is actuated by means of the door key. Current then flows from the battery terminal 1 via the fixed contact 4, the wire 6, the contact 8, the switch member 11, the contact 13 and the wire 16 to the DC motor 18 and from there, via the wire 17, the contact 14 and the switch member 12, to the vehicle ground 15. The DC motor therefore starts up and produces a vacuum. This vacuum is propagated via the conduit 21 so that a vacuum is also produced in the pressure chamber 22 of the holding circuit switch. In this way the diaphragm 24 is moved with the piston rod 25 to the right, as seen in the drawing. This has the result that the contact finger 26 comes against the contact 28 and, upon further displacement, moves the contact bridge 29 to the right, as seen in the drawing, as a result of further vacuum build-up in the pressure chamber 22.

By the contact of the contact finger 26 with the contact 28, the current still passes through the DC motor 18 in the same direction if immediately after the contacting of the fixed contact 4 of the door switch, switching is effected back into the door switch position shown, in which the switch member 3 connects the fixed contact 5 to the battery terminal 1. Current then flows from the battery terminal 1 via the switch member 3 to the fixed contact 5, the wire 7 and the wire 30 over the contact bridge 29 and the contact 28 to the contact finger 26 and from there via the wire 31 to the wire 6. From there it flows, as described above, through the DC motor 18 and, via the switch member 12, to the vehicle ground 15.

When, due to the further vacuum build-up in the pressure chamber 22, the piston rod 25 has moved so far to the right as seen in the drawing that the contact bridge 29 has swung the lever 32 in clockwise direction beyond its dead center, the lever 32 comes into a right-hand end position as seen in the drawing, carrying along the actuating device 37 of the change-over switch 10. The change-over switch 10 is thereby abruptly switched. The switch member 11 then connects the wire 16 to the vehicle ground 15 while the switch member 12 produces a connection of the DC motor 18 via the wire 7 to the fixed contact 5 of the door switch 2. Due to the sudden swinging of the lever 32, the contact bridge 29 also moves suddenly to the right as seen in the drawing, so that the contact finger 26 no longer makes contact with the contact 28. The contact 27 has in this position come relatively close to the contact finger 26.

If now the door switch is switched back into the position shown in the drawing, the DC motor 18 starts up again. By its changed direction of rotation the pump 19 produces pressure so that the diagphragm 24, together with the piston rod 25, moves towards the left as seen in the drawing. By contact between the contact finger 26 and the contact 27, a holding circuit is again closed. Further displacement of the piston rod 25 as a result of the increasing build-up of pressure in the pressure chamber 22 causes the lever 32 to move back into the position shown, thereby abruptly switching the change-over switch 10.

Due to the fact that the flexure beam 34 has clearance between the stops 35, 36 it can flex initially over its entire length and thus relatively easily. As soon as it comes against one of the stops 35, 36 its flexing length becomes shorter so that a considerably greater force is necessary for further displacement of the piston rod 25. The ends of the flexure beam 34 are secured to rod 25 and to fixed part 40.

Abutment stops 35, 36 can be adjustably displaceably mounted longitudinally relative the flexure beam 34 to adjust the strength of the flexing force after abutment of the flexure beam 34 against one of the stops 35, 36.

The actuating device 37 of the change-over switch 10 (also called a reversing switch) is formed with a sideways disposed F-shaped actuating device 37, the parallel portions of which are respectively engaged by a free end of the lever 32 for displacing the actuating device 37 and the switch members 11, 12 which are jointly connected to the actuating device 37.

When the DC motor 18 is turned off after reaching an end position of the diaphragm 24 and piston rod 25, the vacuum or respectively the pressure does not hold the flexure member 34 in the bent position, since the pump is then connected to atmosphere.

While there has been disclosed one embodiment of the invention it is to be understood that this embodiment is given by example only and not in a limiting sense.

I claim:

1. In a device for the unlocking and locking of doors, particularly the doors of automotive vehicles, in which locking mechanisms with pneumatic setting members are provided on individual doors and a pneumatic pump having a motor of controlled direction of rotation is provided centrally, the pump being operatively connected to the pneumatic setting members of the locking mechanisms, the device being actuated by a door key by at least one door switch having two fixed contacts defining two positions for the door switch, and a holding circuit means controlled by a holding circuit switch being provided for both positions for assuring, even upon merely a brief contacting by the door switch with one of the contacts, that the setting members always move into an end position associated therewith, the device having means for switching current in the device when a corresponding end position of the setting members is reached, the improvement wherein said motor constitutes a DC motor, said holding circuit switch comprises means including a diaphragm defining a pressure chamber communicating with said pump, a piston rod connected to said diaphragm and axially displaceable by said diaphragm, a contact finger being mounted on said piston rod, a contact bridge mounted displaceably parallel to the piston rod and having two spaced contacts, said contact finger on said piston rod extending between said two contacts of said contact bridge and being adapted to contact either of said two contacts of said contact bridge or to be spaced from both of said two contacts of said contact bridge and constitutes means for displacing said contact bridge via said two spaced contacts, respectively, when said piston rod is displaced, said switching means comprises a change-over switch means having two bistable switch members arranged parallel to each other and electrically connected to said motor, said change-over switch means being movable between two positions, in respective of said two positions of said change-over switch means, a respective one of said switch members is electrically connected to one of said fixed contacts of the door switch and the other of said switch members is electrically connected to a ground connection, respectively, whereby said two fixed contacts of said door switch respectively being connected electrically to the motor via the change-over switch means, said contact bridge is operatively mechanically connected with said switch members of the change-over switch means, said holding circuit means includes said two contacts of the contact bridge being electrically connected to one of the fixed contacts of the door switch and said contact finger of said piston rod electrically connected to the other of said fixed contacts, a flexing member constituting means for biasing and holding respectively said piston rod in a basic position with said contact finger not contacting either of said two spaced contacts, said flexing member is connected to said piston rod and flexing upon displacement of said piston rod, two abutment means each respectively for contacting said flexing member when said piston rod is displaced predetermined extents in respective of two axial directions of displacement, and upon said contacting for shortening the flexing length of said flexing member, the latter having a spring characteristic bent off once in both directions of displacement, respectively.

2. The device as set forth in claim 1, wherein said abutment means are displaceable in a longitudinal direction of the flexing member, the latter extending transverse relative to said piston rod.

3. The device as set forth in claim 1 or 2, wherein said flexing member at an end thereof remote from said piston rod is connected to a fixed member.

4. In a device for the unlocking and locking of doors, particularly the doors of automotive vehicles, in which locking mechanisms with pneumatic setting members are provided on individual doors and a pneumatic pump having a motor of controlled direction of rotation is provided centrally, the pump being operatively connected to the pneumatic setting members of the locking mechanisms, the device being actuated by a door key by at least one door switch having two fixed contacts defining two positions for the door switch, and a holding circuit means controlled by a holding circuit switch being provided for both positions for assuring, even upon merely a brief contacting by the door switch with one of the contacts, that the setting members always move into an end position associated therewith, the device having means for switching current in the device when a corresponding end position of the setting member is reached, the improvement wherein said motor constitutes a DC motor, said holding circuit switch comprises means including a diaphragm defining a pressure chamber communicating with said pump, a piston rod connected to said diaphragm and axially displaceable by said diaphragm, a contact finger being mounted on said piston rod, a contact bridge mounted displaceably parallel to the piston rod and having two spaced contacts, said contact finger on said piston rod extending between said two contacts of said contact bridge and being adapted to contact either of said two contacts of said contact bridge or to be spaced from both of said two contacts of said contact bridge and constitutes means for displacing said contact bridge via said two spaced contacts, respectively, when said piston rod is displaced, said switching means comprises a change-over switch means having two bistable switch members arranged parallel to each other and electrically connected to said motor, said change-over switch means being movable between two positions, in respective of said two positions of said change-over switch means, a respective one of said switch members is electrically connected to one of said fixed contacts of the door switch and the other of said switch members is electrically connected to a ground connection, respectively, whereby said two fixed contacts of said door switch respectively being connected electrically to the motor via the change-over switch means, said contact bridge is operatively mechanically connected with said switch members of the change-over switch means, said holding circuit means includes said two contacts of the contact bridge being electrically connected to one of the fixed contacts of the door switch and said contact finger of said piston rod electrically connected to the other of said fixed contacts, means comprising a pivotally mounted lever mechanically connected to said contact bridge and for being moved by the latter when displaced and operatively mechanically connected to said change-over switch means for movement of said change-over switch means, tension spring means for moving and holding said lever in two end positions thereof, respectively, said lever and said change-over switch means cooperatively disposed such that in respective of said two end positions, said change-over switch means is in respective of said two positions of said switch members, said tension spring means for abruptly snappingly moving said lever into respective of said two end positions thereof and moving said change-over switch means and said contact bridge abruptly into respective end positions respectively thereof in which said change-over switch means is switched over to disconnect from a respective of said fixed contacts and to break contact between a respective of said contacts of said contact bridge and said contact finger and spacing the latter close to the other of said contacts of said contact bridge when said contact bridge pivots said lever beyond a dead center position of the latter in which the fulcrum of said lever, a fixed mounting end of said tension spring means and the point of connection of said tension spring means to said lever are linearly aligned.

5. The device as set forth in claim 4, wherein said contact finger is spaced closely from but without contacting a respective one of said contacts of said contact bridge in respective of the end positions of the setting members, said respective one of said contacts of said contact bridge being next to said contact finger in a direction of displacement of said contact finger next occurring upon switching over of said door switch.

6. The device as set forth in claim 5 or 4, wherein said change-over switch means includes a sideways oriented F-shaped member jointly connected to said switch members, a free end of said lever engages between parallel portions of said F-shaped member.

7. The device as set forth in claim 1 or 4 wherein said pump constitutes means for providing vacuum or pressure respectively depending on the directions of rotation of said motor, said motor constituting means for being rotated in different of the directions of rotation depending on the direction of current passing through said motor.

8. The device as set forth in claim 1 or 4, wherein said contact finger is formed with contacts on both sides thereof facing said two spaced contacts of said contact bridge, said contact member has an F shape and is sideways oriented, said contacts of said contact bridge form parallel extensions of said F-shaped contact bridge.

9. The device as set forth in claim 1 or 4, wherein said contact finger radially extends from said piston rod.

10. The device as set forth in claim 8, wherein said contact finger radially extends from said piston rod.

* * * * *